US012584427B2

(12) United States Patent
Correa et al.

(10) Patent No.: US 12,584,427 B2
(45) Date of Patent: Mar. 24, 2026

(54) RESET VALVE FOR COMPRESSION RELEASE BRAKE

(71) Applicant: Cummins Inc., Columbus, IN (US)

(72) Inventors: Dixon Malcolm Correa, Columbus, IN (US); Arnab Chanda, Pune (IN); Alan Ronald Bennett, Indianapolis, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 18/940,598

(22) Filed: Nov. 7, 2024

(65) Prior Publication Data

US 2025/0146431 A1 May 8, 2025

Related U.S. Application Data

(60) Provisional application No. 63/597,254, filed on Nov. 8, 2023.

(51) Int. Cl.
*F01L 13/06* (2006.01)
*F01L 1/18* (2006.01)

(52) U.S. Cl.
CPC ..... *F01L 13/065* (2013.01); *F01L 1/18* (2013.01); *F01L 13/06* (2013.01)

(58) Field of Classification Search
CPC ..... F01L 13/065; F01L 13/06; F01L 2305/00; F01L 1/18; F02B 75/02
See application file for complete search history.

(56) References Cited

U.S. PATENT DOCUMENTS

| | | | | |
|---|---|---|---|---|
| 4,399,787 | A * | 8/1983 | Cavanagh | F02D 13/04 123/321 |
| 4,706,625 | A | 11/1987 | Meistrick et al. | |
| 6,253,730 | B1 * | 7/2001 | Gustafson | F01L 13/065 123/321 |
| 6,691,674 | B2 | 2/2004 | McCarthy et al. | |
| 8,991,350 | B2 | 3/2015 | Yang | |
| 9,249,698 | B2 | 2/2016 | Gustafson et al. | |
| 10,190,451 | B2 | 1/2019 | Mcneely et al. | |
| 11,255,230 | B2 | 2/2022 | Jeon | |
| 2010/0170472 | A1 * | 7/2010 | Yang | F01L 1/181 123/321 |
| 2022/0205373 | A1 | 6/2022 | Correa | |

FOREIGN PATENT DOCUMENTS

| | | | |
|---|---|---|---|
| WO | WO-2015017057 A1 * | 2/2015 | F01L 9/20 |

* cited by examiner

*Primary Examiner* — Syed O Hasan
(74) *Attorney, Agent, or Firm* — Taft Stettinius & Hollister LLP

(57) ABSTRACT

An engine brake reset valve includes a cylindrical housing body having an end and a central cavity therein. The reset valve includes a first valve part attached to a second valve part, wherein the central cavity is sized to receive the first valve part and the second valve part. The first and second valve parts are movable within the central cavity between open and closed positions. When the second valve part is in a closed position, the second valve part engages and blocks the central orifice to prevent fluid pressure from entering the central orifice. When the second valve part is in an open position, the second valve part moves away from the central orifice to enable fluid pressure to enter the central orifice.

6 Claims, 8 Drawing Sheets

RESET VALVE FOR COMPRESSION RELEASE BRAKE

CROSS-REFERENCE TO RELATED APPLICATION

The present application claims the benefit of the filing date of U.S. Provisional Application No. 63/597,254 filed on Nov. 8, 2023, which is incorporated herein by reference.

TECHNICAL FIELD

The present application relates generally to an exhaust valve opening apparatus such as for compression release braking or early exhaust valve opening operations, and more particularly to a reset valve for a compression release brake.

BACKGROUND

Exhaust valve opening devices are used for compression braking for heavy vehicles and for early exhaust valve opening for combustion and thermal management. For example, compression braking converts an internal combustion engine cylinder to a compressor by opening an exhaust valve of the cylinder near the end of the compression stroke. This allows the power generated in the piston to escape to the atmosphere rather than continuing to power the crankshaft of the vehicle, and the use of service brakes can be minimized, extending their life. Moreover, the escape of the power generated in the piston to the atmosphere avoids overheating of service brakes.

Exhaust valve opening devices used for compression braking forms an engine braking function that relies on a high pressure hydraulic linkage between primary and secondary pistons. In one form, when a supply oil pressure is high, a retaining spring on the piston is overcome by the supply oil pressure causing the oil volume in the high pressure circuit to build up or increase. Over time, this increase in supply oil pressure can cause the secondary piston to track the exhaust valve motion during the exhaust valve motion during the exhaust stroke resulting in a jacking effect where the secondary piston progressively fails to return to its initial position during every braking cycle. This condition is potentially dangerous as the incomplete closure of the exhaust valve can result in valve to piston contact and catastrophic failure of the engine. Several solutions exist to mitigate this concern including utilizing a stiffer retention spring and including a pressure regulation device in the circuit. However, these solutions require additional packaging volume which may not always exist in the design. Therefore, further improvements in this area of technology are desired.

SUMMARY

A unique reset valve for a compression release brake prevents jacking of secondary pistons and facilitates exhaust valves closing during a main exhaust event. The reset valve for a compression release brake also prevents exhaust valve to piston contact. The reset valve for a compression release brake is positioned in a high pressure brake circuit to bleed oil or fluid pressure when the primary piston returns to the base circle of the cam lobe. The reset valve for a compression release brake enables an engine brake system to tolerate a higher oil supply pressure and enables the engine brake system to be less sensitive to supply pressure variation.

The reset valve disclosed herein is also beneficial when an overall engine package size constraint does not permit the use of a pressure relief valve in the oil supply circuit. The reset valve is also beneficial when the engine package size constraint does not permit the use of a stiffer retaining spring.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The concepts described herein are illustrative by way of example and not by way of limitation in the accompanying figures. For simplicity and clarity of illustration, elements illustrated in the figures are not necessarily drawn to scale. Where considered appropriate, references labels have been repeated among the figures to indicate corresponding or analogous elements.

DETAILED DESCRIPTION OF ILLUSTRATIVE EMBODIMENTS

Figure 1:
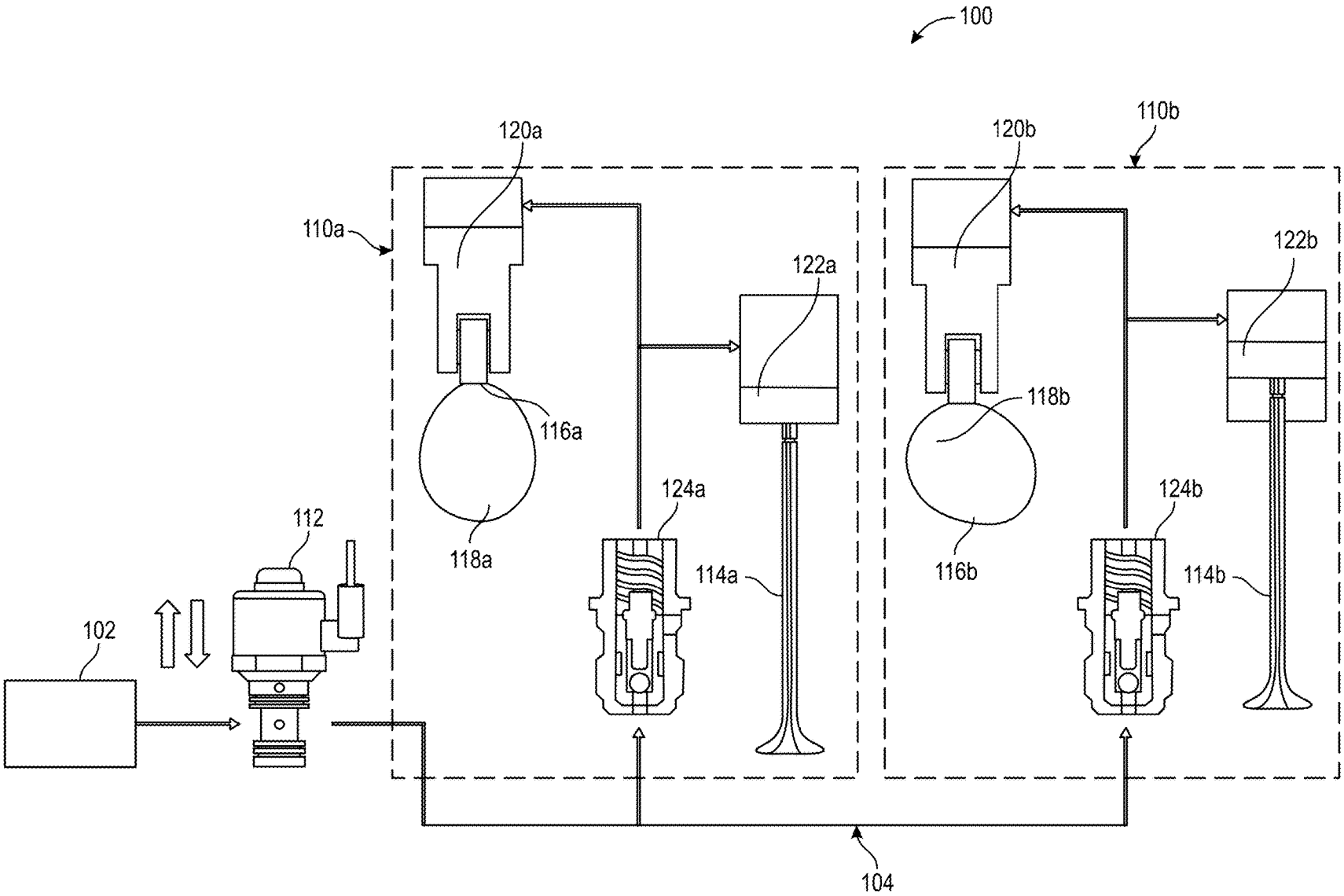
FIG. 1 is a schematic illustration of an embodiment of an exhaust valve opening system according to the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Turning now to the present application with reference to FIG. 1, is an embodiment of an exhaust valve opening system 100 that includes a control fluid supply 102 that is operable to supply a control fluid to a first cam housing part 110*a* and a second cam housing part 110*b* to open first and second exhaust valves 114*a*, 114*b*. In particular, when enabled by system 100, cam lobes 118*a*, 118*b* act on the roller followers 116*a*, 116*b* of the first and second primary pistons 120*a*, 120*b* to displace respective first and second secondary pistons 122*a*, 122*b* that are connected respective ones of the first and second exhaust valves 114*a*, 114*b*, thus opening and closing the exhaust valves 114*a*, 114*b*.

System 100 includes a controllable valve 112, such as a solenoid valve, that is mounted to a rocker shaft 104 and receives the control fluid from a passage of the rocker shaft 104, which is fluidly connected to the control fluid supply 102. The controllable valve 112 is operable to pressurize the control fluid and provide the control fluid, through another passage of the rocker shaft 104, to first check valve 124*a* of the first cam housing part 110*a* and, through the passage of the rocker shaft 104, to a second check valve 124*b* of the second cam housing part 110*b*.

First check valve 124*a* receives the pressurized control fluid from controllable valve 112 via the rocker shaft 104 and prevents reverse flow so that in response to the cam lobe 118*a* displacing the first primary piston 120*a*, a corresponding displacement of first secondary piston 122*a* is provided that opens first exhaust valve 114*a*. Second check valve 124*b* receives the pressurized control fluid from controllable valve 112 via the rocker shaft 104 and prevents reverse flow so that in response to the cam lobe 118*b* displacing the second primary piston 120*b*, a corresponding displacement of the second secondary piston 122*b* is provided that opens second exhaust valve 114*b*.

Figure 2:
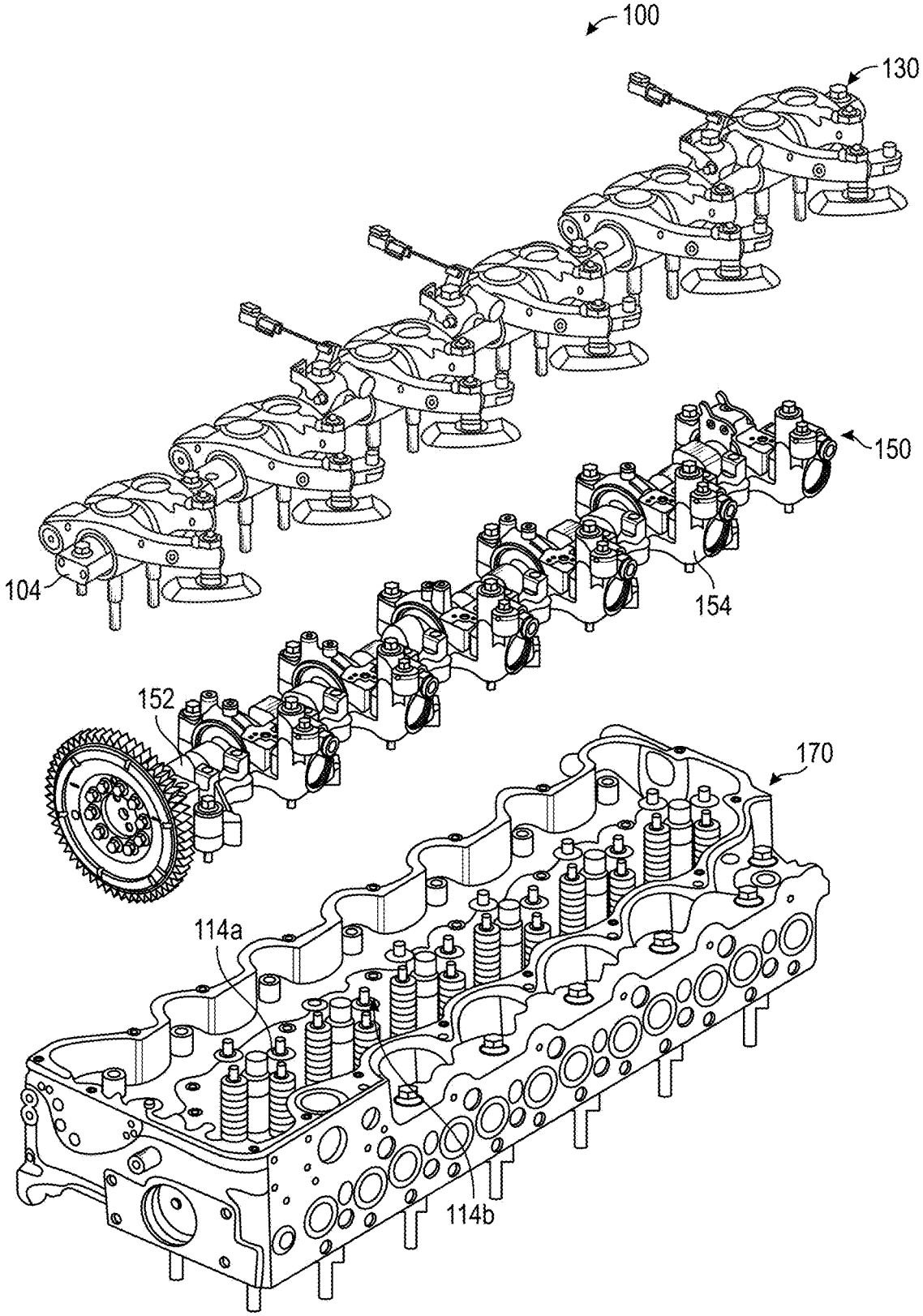
FIG. 2 is an exploded perspective view of the exhaust valve opening system of FIG. 1.

Referring to FIG. 2, the exhaust valve opening system 100 includes a rocker lever assembly 130 that houses the rocker levers of the engine along with rocker shaft 104. Exhaust valve opening system 100 further includes a cam housing assembly 150 that includes a cam housing 154 for housing a cam shaft 152 that carries the cam lobes 116*a*, 116*b*. Exhaust valve opening system 100 also includes a cylinder head assembly 170 that is mountable to the engine block to support first and second exhaust valves 114*a*, 114*b*, along with the intake valves and other components, in the desired configuration relative to the respective engine cylinders.

Figure 3:
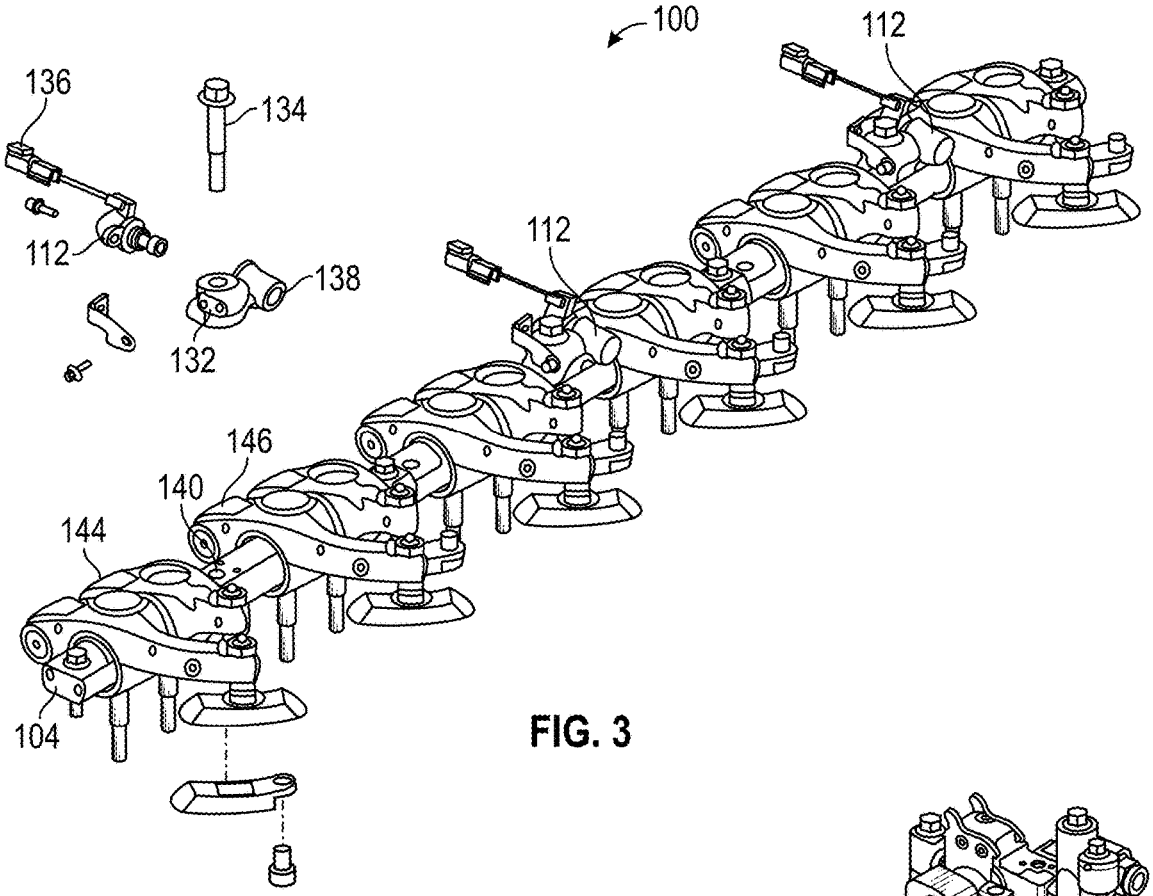
FIG. 3 is an exploded perspective view of a rocker lever assembly of the exhaust valve opening system of FIG. 1.

Referring to FIG. 3, rocker lever assembly 130 is shown with controllable valves 112, one of which is in an exploded view. Controllable valves 112 are mounted to rocker shaft 104 so that each controllable valve 112 is spaced along rocker shaft 104 and is associated with a respective pair of exhaust valves 114*a*, 114*b* of a pair of cylinders. In one embodiment, a valve housing 132 is fastened to rocker shaft 104 with a fastener 134 in hole 140 of rocker shaft 104 between rocker levers 144, 146. Embodiments without a valve housing 132 are also contemplated. As discussed further below, rocker shaft 104 includes flow passages to provide control fluid to and from controllable valve 112. Valve housing 132 includes a receptacle 138 to receive controllable valve 112. Each controllable valve 112 also includes a wiring harness 136 for engagement to a control system that provides signal to activate and deactivate controllable valve 112 to selectively supply pressurized control fluid.

Figure 4:
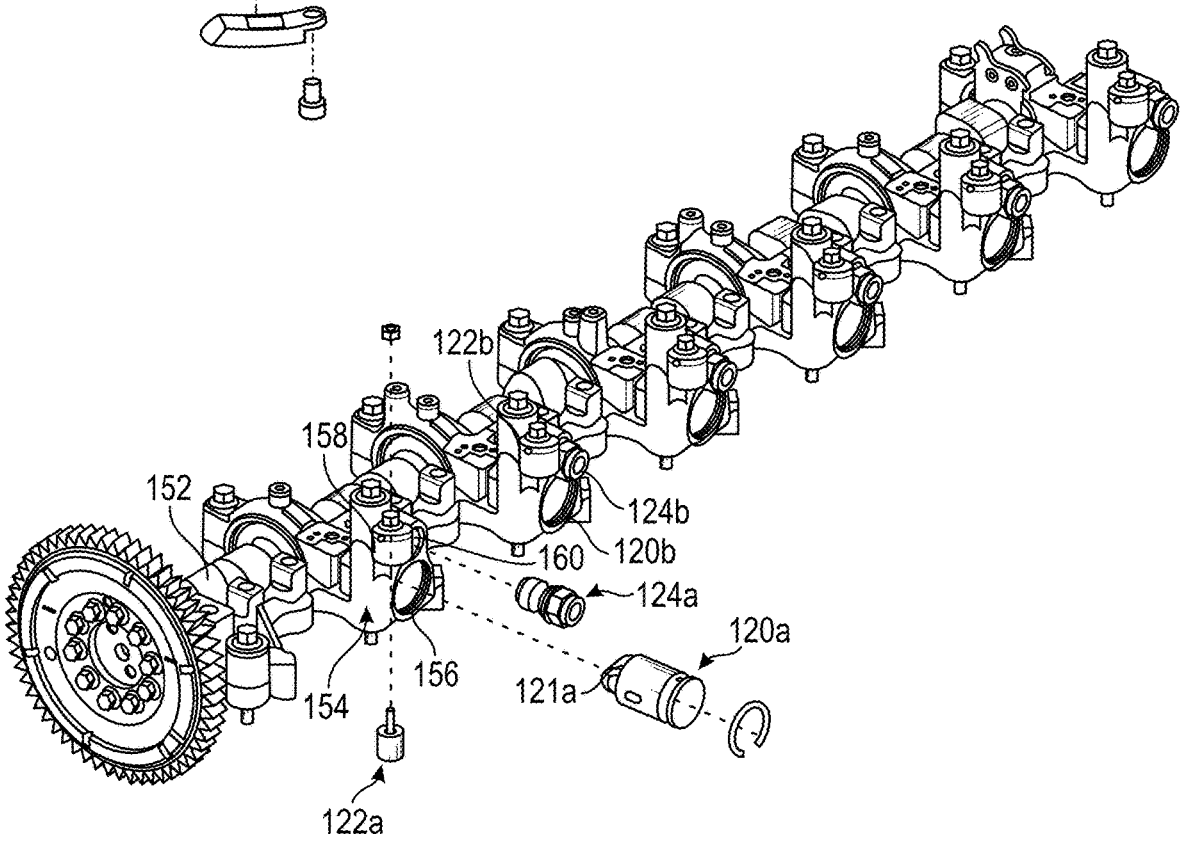
FIG. 4 is an exploded perspective view of a cam housing assembly of the exhaust valve opening system of FIG. 1.

Referring to FIG. 4, cam housing assembly 150 is shown with check valve 124*a*, primary piston 120*a*, and secondary piston 122*a* in an exploded view. First primary piston 120*a* is engaged in a first receptacle 156 of cam housing 154, such as shown with second primary piston 120*b*. As described in FIGS. 8 and 9, end 121*a* of primary piston 120*a* includes a first roller or other member 802*a* to contact the cam lobe 116*a*. When the control fluid is de-energized, the primary piston 120*a* is configured to collapse in response to passage of the cam lobe 116*a* there against, but is configured to be locked by the control fluid to prevent collapse when exhaust valve opening is desired. First secondary piston 122*a* is engaged in a second receptacle 158 of cam housing 154, such as shown with second secondary piston 122*b*. First check valve 124*a* is engaged in third opening 160 of cam housing 154, such as shown with second check valve 124*b*.

Figure 5:
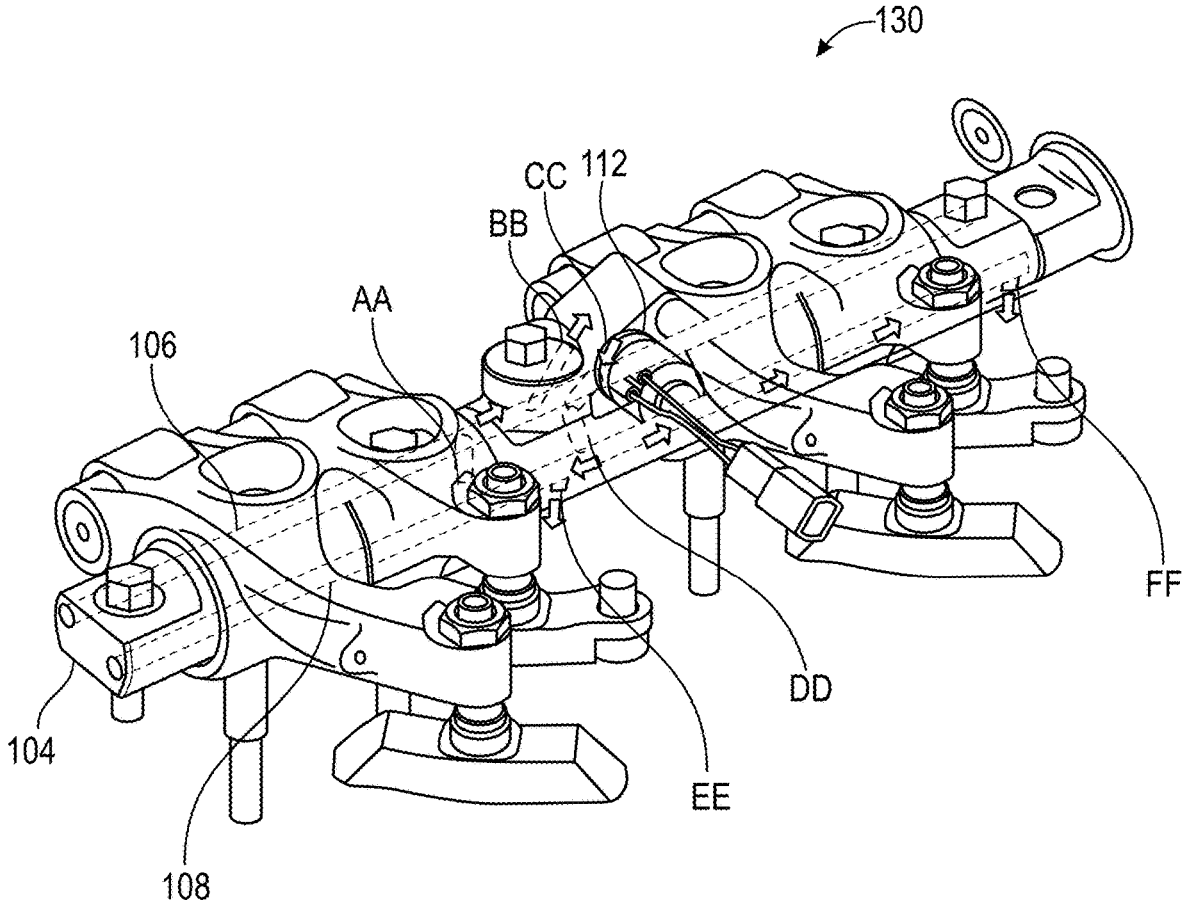
FIG. 5 is a schematic illustration of the fluid flow paths through a rocker shaft of the exhaust valve opening system of FIG. 1 to supply control fluid to the cam housing assembly.

FIG. 5 shows a schematic of the arrangement of the control fluid delivery circuit to check valves 124*a*, 124*b* via rocker shaft 104. Rocker shaft 104 includes a controllable valve flow path 106 and a check valve flow path 108, each extending longitudinally through rocker shaft 104 with transverse portions to provide the necessary flow path connections. Controllable valve flow path 106 is connected at point AA to control fluid supply 102 to provide the control fluid to controllable valve 112 at inlet BB.

In response to a command or operation of open the exhaust valves 114*a*, 114*b*, controllable valve 112 is energized to pressurize the control fluid. Controllable valve 112 includes an outlet CC that is connected to check valve flow path 108 at point DD in rocker shaft 104. Check valve flow path 108 extends to and is connected to first check valve 124*a* at point EE and to second check valve 124*b* at point FF to deliver pressurized control fluid to the check valves 124*a*, 124*b* mounted to the cam housing 154.

Figure 6:
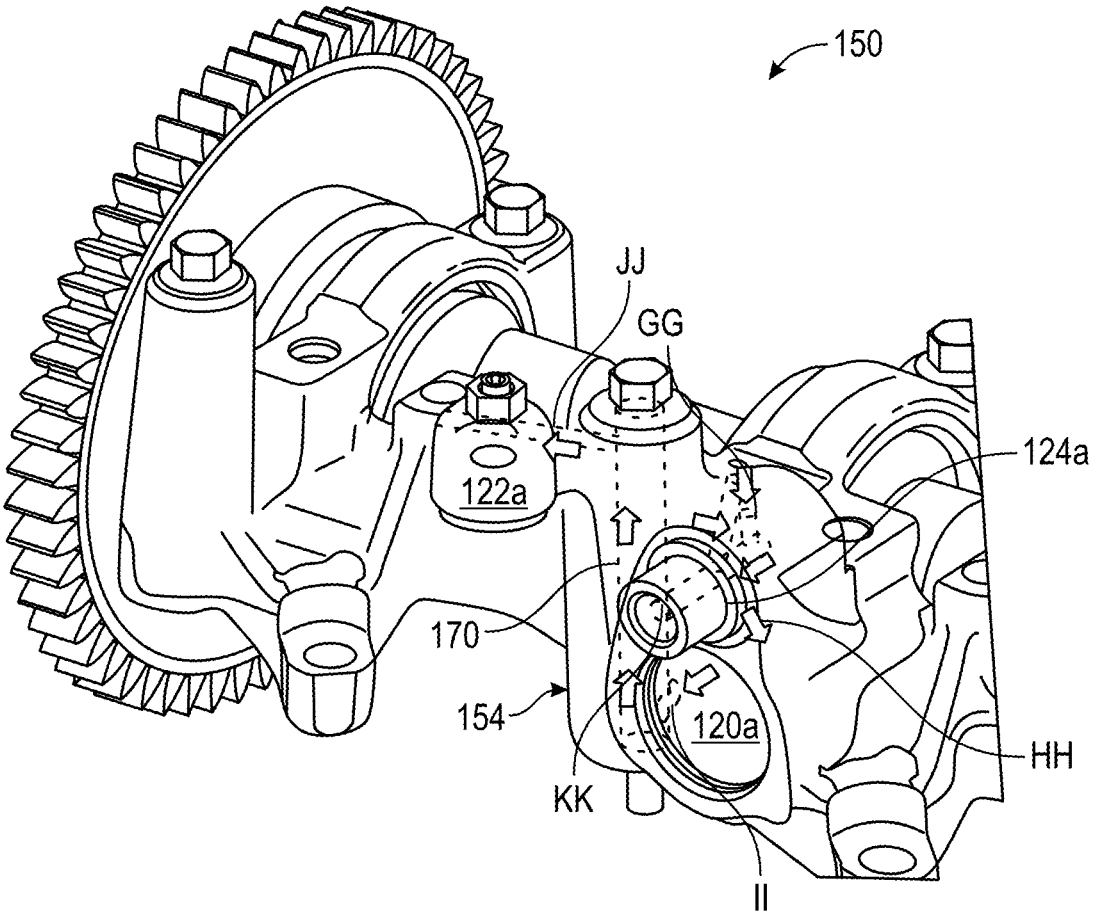
FIG. 6 is a schematic illustration of the fluid flow paths in the cam housing assembly of the exhaust valve opening system of FIG. 1 to receive control fluid from the rocker shaft of FIG. 5 and supply control fluid to the various components of the cam housing assembly.

Referring to FIG. 6, the flow path in the cam housing 154 for one check valve 124*a* is shown, it being understood the flow paths in cam housing 154 for the other check valves can be similarly configured. Cam housing 154 receives control fluid from rocker shaft 104 at inlet GG to the check valve 124*a*. Pressurized control fluid exits check valve 124*a* and is provided to primary cylinder 120*a* at point HH. Pressurized control fluid is further provided from primary cylinder 120*a* at an outlet II to a cam housing flow passage 170. Cam housing flow passage 170 extends longitudinally to provide control fluid to an inlet JJ of secondary piston 122*a*. When controllable valve 112 is de-energized, control fluid can bleed back through check valve 124*a* at bleed outlet KK to allow the exhaust valves 114*a*, 114*b* to rapidly close.

Figure 7A:
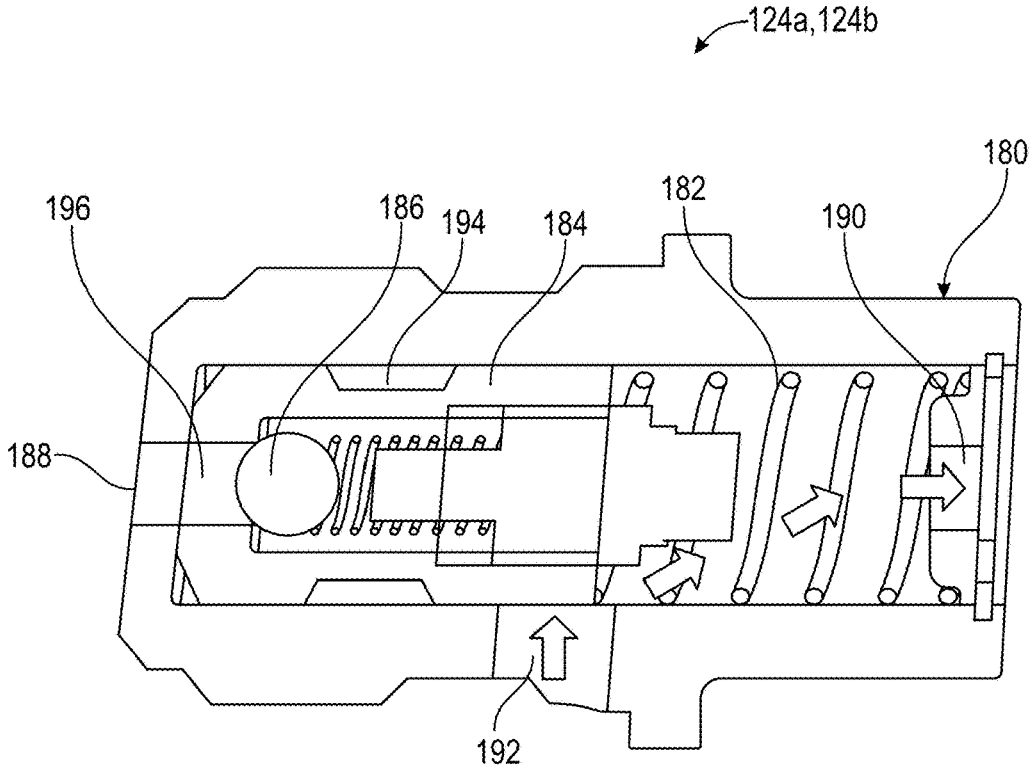
FIGS. 7A and 7B are cross-sectional views of a check valve of the exhaust valve opening system of FIG. 1.
Figure 7B:
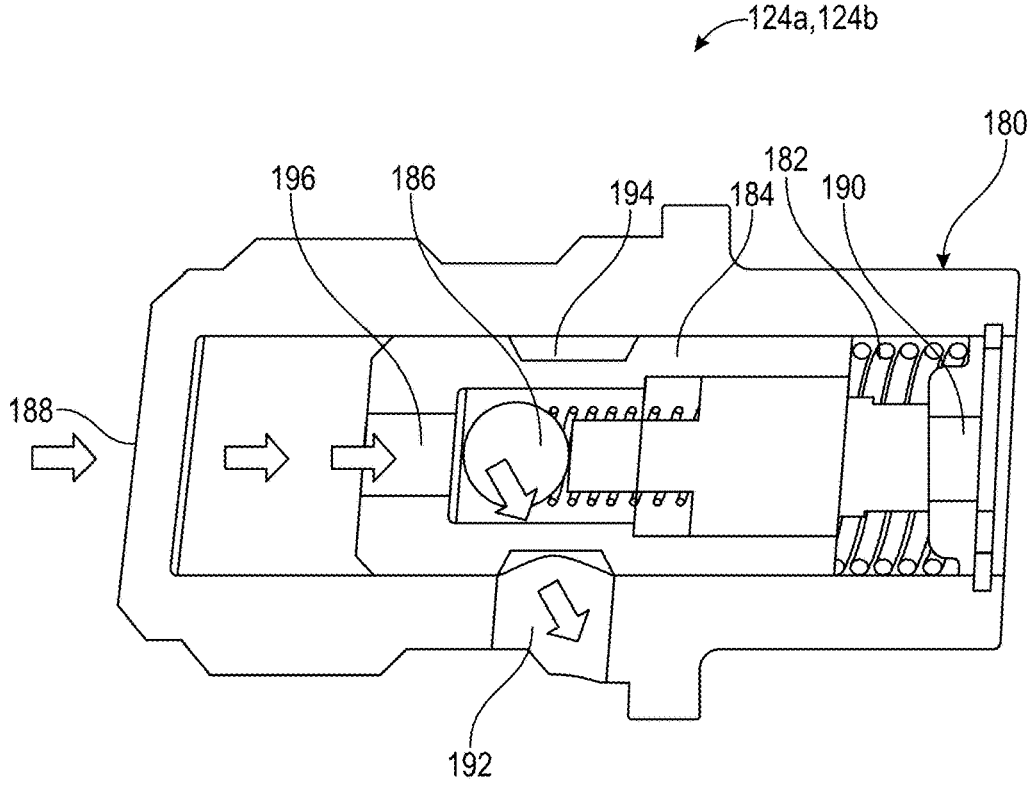

FIGS. 7A-7B show an embodiment of check valves 124*a*, 124*b* that is configured to allow pressurized control fluid to bleed back there through in response to controllable valve 112 being de-energized. This embodiment check valve includes a cylindrical housing body 180 with a central cavity for housing a spring 182, a first valve part 184, and a second valve part 186. First valve part 184 includes a recessed side hole(s) 194 there through. Housing body 180 includes an inlet 188 at one end thereof and an outlet 190 at the opposition end thereof. Housing body 180 further includes at least one hole 192 in the side thereof.

In FIG. 7B check valve 124*a*, 124*b* is opened since pressurized control fluid compresses spring 182 to unseat first valve part 184 from inlet 188 and unseat second valve part 186 from end opening 196 of first valve part 184. This allows control fluid to flow into the cavity of housing body 180, through the end opening 196 of first valve part 182, and out of the aligned holes 192, 194 to the primary piston 120*a*. The outlet 190 of housing body 180 is simultaneously closed by second valve part 186.

In FIG. 7A the controllable valve 112 is de-energized and the control fluid is not actively pressurized, allowing first valve part 184 to seat against housing body 180 and second valve part 186 to seat against end opening 196 via spring 182, preventing control fluid from entering housing body 180. However, hole 192 is only partially obstructed by first valve part 184, allowing fluid to flow back into the housing cavity through hole 192 and through the outlet 190, allowing the pressure from the control fluid to bleed from primary piston 120*a* to the oil sump so that the exhaust valve is no longer opened by the exhaust valve opening system 100.

Figure 8:
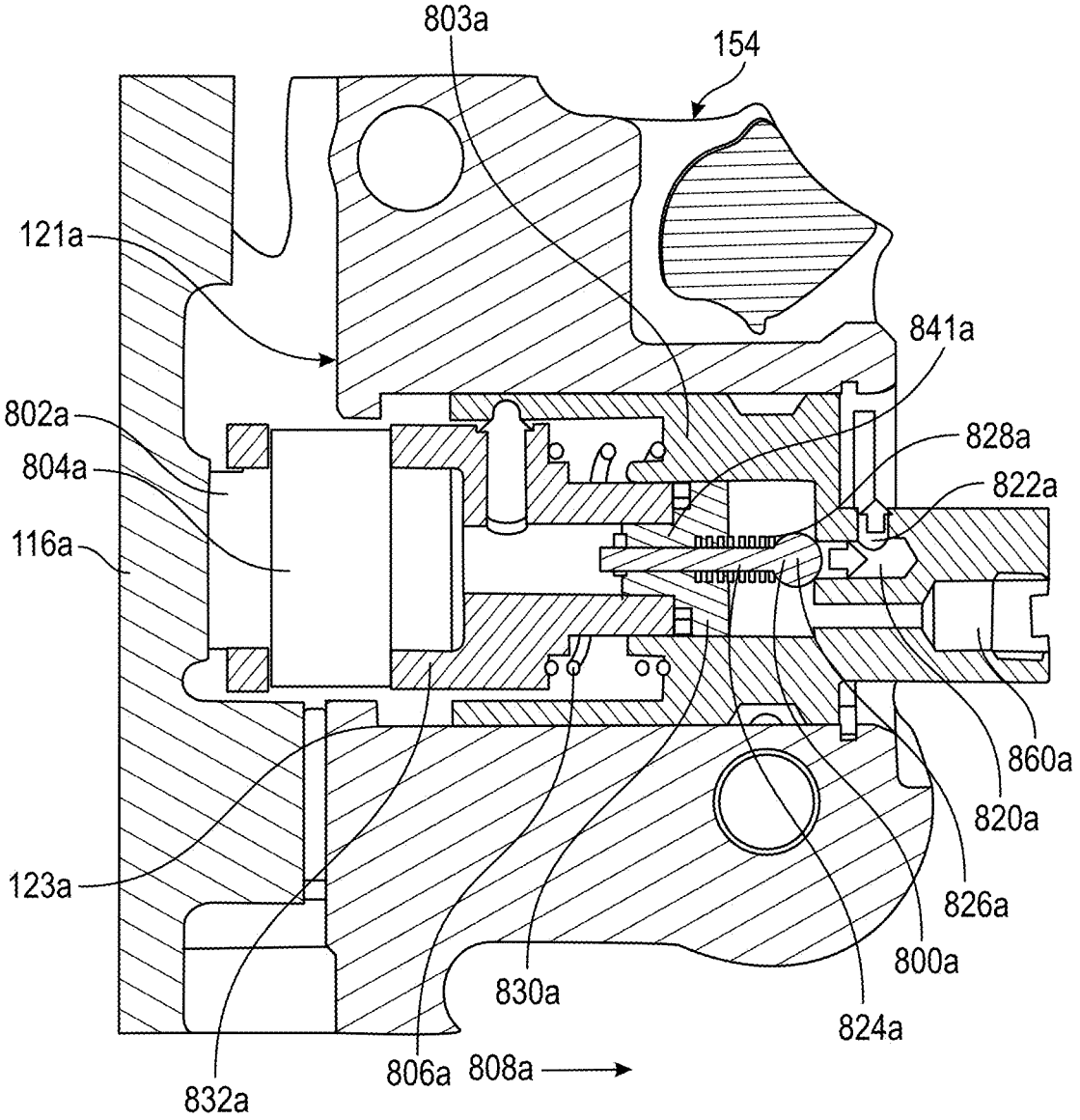
FIG. 8 is a first cross-sectional view of an engine brake reset valve of the exhaust valve opening system of FIG. 1.
Figure 9:
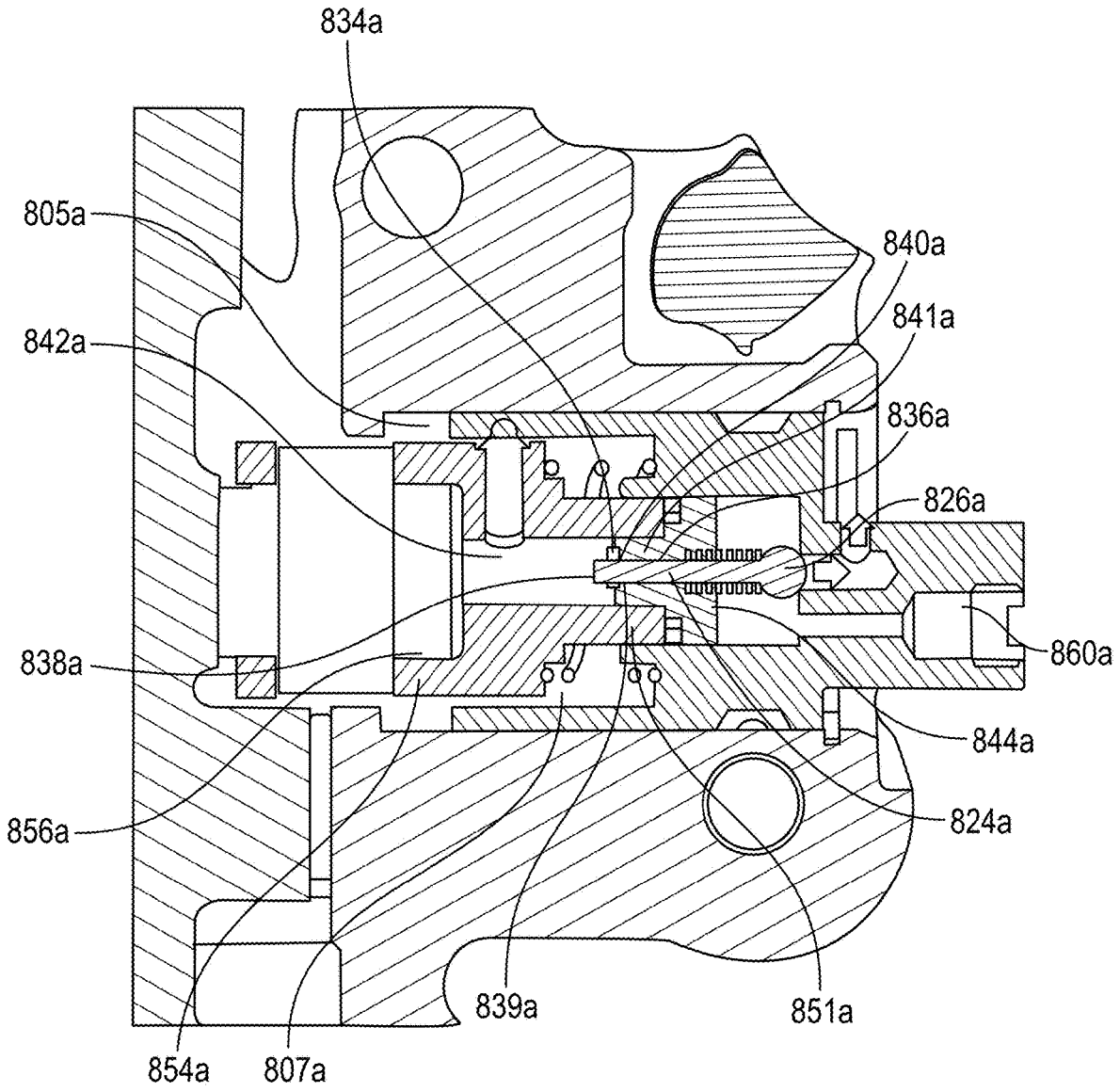
FIG. 9 is a second cross-sectional view of the engine brake reset valve of FIG. 8.

Turning now to FIGS. 8 and 9, are cross-sectional views of the cam housing 154 that includes the first primary piston 120*a* and an engine brake reset valve 800*a*. The second primary piston 120*b* is similar to the first primary piston 120*a*, therefore is not described. As described above, when enabled by system 100, cam lobe 116*a* of the corresponding cam shaft 118*a* acts on the first primary piston 120*a* to displace the first secondary piston 122*a* that is connected to the first exhaust valve 114*a* thus opening and closing the exhaust valve 114*a*. The engine brake reset valve 800*a* is configured to allow control fluid pressure to bleed therethrough in response to the first primary piston 120*a* being on cam lobe 116*a* base circle.

The end 121*a* of cam housing 154 includes a central cavity 123*a* sized to receive the primary piston 120*a* and engine brake reset valve 800*a*. The central cavity 123*a* is also sized to receive a first roller or other member 802*a* to contact the cam lobe 116*a*. When the control fluid is de-energized, the first primary piston 120*a* is configured to collapse in response to passage of the cam lobe 116*a* there against, but is configured to be locked by the control fluid to prevent collapse when opening of exhaust valve 114*a* is desired.

The first primary piston 120*a* assembly includes a cylindrical housing body 803*a* that includes an end 805*a* and a central cavity 807*a* therein. The central cavity 807*a* is sized to receive a first spring 806*a* arranged to continuously apply pressure relative to movement of the cam lobe 116*a* against the first primary piston 120*a*. When the cam lobe 116*a* rotates such that the base circle of the cam shaft 118*a* is positioned next to the piston 120*a*, the cam lobe 116*a* has moved away from the first spring 806*a* thereby enabling or releasing the first spring 806*a* to push or engage the first primary piston 120*a* towards the base circle of the cam shaft 118*a*.

The central cavity 807*a* is further sized to receive a first valve part 824*a*, a second valve part 826*a*, a second spring 828*a*, a first primary piston crown 830*a*, and a first primary piston body 832*a*. The first valve part 824*a* is connected or monolithic with a second valve part 826*a*. The first valve part 824*a* has a length sufficient to receive the second spring 828*a* on a first portion of the length. The first valve part 824*a* has a length sufficient to engage or fit in a through-hole 836*a* of the first primary piston crown 830*a* via a second portion of the length. In the illustrated embodiment, the first valve part 824*a* is cylindrical in shape but may have different cross-sectional shapes in other embodiments. The first valve part 824*a* includes a recessed side hole(s) 840*a* there through configured to receive a retention clip 834*a* at or near an end 838*a* of the first valve part 824*a* for engagement with the first primary piston crown 830*a*. The retention clip 834*a* is configured to retain the first valve part 824*a* assembled to the first primary piston crown 830*a*.

The second valve part 826*a* is a check ball with a spherical shape but may have different shapes in other embodiments. The second valve part 826*a* is sized to engage and block a central orifice 820*a* in the cylindrical housing body 803*a* to prevent fluid or oil pressure from entering the central orifice 820*a*. When the base circle of the cam shaft 118*a* is positioned next to the first primary piston 120*a*, the engine brake reset valve 800*a* is open such that the second valve part 826*a* is open or away from the central orifice 820*a* to enable bleeding of control fluid pressure from the high pressure oil circuit between the first primary piston 120*a* and the first secondary piston 122*a* through the central orifice 820*a* and the lateral orifice 822*a* which prevents motion transfer from the first primary piston 120*a* to the first secondary piston 122*a*. When the first primary piston 120*a* begins to move, the engine brake reset valve 800*a* closes such that the second valve part 826*a* closes or seals the central orifice 820*a* to prevent oil pressure from bleeding to thereby maintain the oil pressure in the high pressure oil circuit between the first primary piston 120*a* and the first secondary piston 122*a* and allow or enable motion transfer to the first secondary piston 122*a*.

The first primary piston crown 830*a* includes a cylindrical portion 841*a* that receives a through-hole 839*a* therein that is sized to receive the first valve part 824*a* and assembly of the retention clip 840*a* to retain the first valve part 824*a* with the first primary piston crown 830*a*. The cylindrical portion 841*a* extends to a flared portion 844*a* that includes a portion of the through-hole 839*a* for receipt of a portion of the second spring 828*a*.

The first primary piston body 832*a* includes a cylindrical portion 851*a* that receives a through-hole 842*a* therein that is sized to receive and retain the cylindrical portion 841*a* of the first primary piston crown 830*a* therein. The cylindrical portion 851*a* of the first primary piston body 832*a* is sized to receive the first spring 806*a* thereon. The first primary piston body 832*a* includes a through-hole 842*a* that extends the length of the first primary piston body 832*a*. The cylindrical portion 851*a* extends to a flared portion 854*a* that includes an opening 856*a* that opens or connects to the through-hole 842*a*. The opening 856*a* is sized to receive a portion of the first roller 802*a* therein. The first spring 806*a* is sized to fit on an outer surface of the cylindrical portion 851*a*.

The first roller 802*a* is rotatably mounted on a first pin 804*a* wherein the first roller 802*a* is rolling or rotating about the first pin 804*a* as the cam lobe 116*a* engages the first roller 802*a*. To push the first primary piston 120*a* open, the cam lobe 116*a* pushes on or against the first roller 802*a* which moves the first primary piston 120*a* in the direction of arrow 808*a*.

The cylindrical housing body 803*a* includes a central orifice 820*a* fluidly connected to a lateral orifice 822*a*. The orientation of the lateral orifice 822*a* to the central orifice 820*a* can vary in other embodiments. For example, the lateral orifice 822*a* may be perpendicular to the central orifice 820*a* or may have a non-perpendicular arrangement. The central and lateral orifices 820*a* and 822*a* are configured to drain excess fluid or oil pressure when the second valve part 824*a* moves away from the central orifice 820*a* to thereby expose the central orifice 820*a*.

In some embodiments, the cylindrical housing body 803*a* includes a pressure tap 860*a* that is a small hole in the cylindrical housing body 803*a* that can receive fluid pressure.

In FIG. 8, the engine brake reset valve 800*a* is open such that the second valve part 826*a* or check ball is in an open position when the base circle of the cam shaft 118*a* is positioned next to the first primary piston 120*a*. The cam lobe 116*a* has moved away from the first spring 806*a* thereby enabling or releasing the first spring 806*a* to push or engage the first primary piston 120*a* towards the base circle of the cam shaft 118*a*. The second valve part 826*a* is open or away from the central orifice 820*a* to enable bleeding of control fluid or oil pressure from the high pressure oil circuit between the first primary piston 120*a* and the first secondary piston 122*a* through the central orifice 820*a* and the lateral orifice 822*a* which prevents motion transfer from the first primary piston 120*a* to the first secondary piston 122*a*. The excess control fluid pressure from the high pressure circuit bleeds through the central orifice 820*a* and then through the lateral orifice 822*a*.

In FIG. 9, when the cam shaft 118*a* rotates such that the cam lobe 116*a* engages the first primary piston 120*a* to force the first primary piston 120*a* and the first and second valve parts 824*a* and 826*a* to move toward the central orifice 820*a*, the engine brake reset valve 800*a* closes such that the second valve part 826*a* closes or seals the central orifice 820*a* to prevent oil pressure from bleeding therein. The first and second valve parts 824*a* and 826*a* move towards the central orifice 820*a* to close or seal the central orifice 820*a* and maintain the oil pressure in the high pressure oil circuit between the first primary piston 120*a* and the first secondary piston 122*a* which allows or enables motion transfer to the first secondary piston 122*a*. The fluid or oil pressure is sealed in the high pressure circuit between the first primary and secondary pistons 120*a* and 122*a*.

The engine brake reset valve 800*a* is designed to open when the first primary piston 120*a* is on base circle of the cam 118*a*, allowing the high pressure to bleed through the central and lateral orifices 820*a* and 822*a*. When the first primary piston 120*a* begins to move, the engine brake reset valve 800*a* closes thereby maintaining pressure in the high pressure circuit to lift the first secondary piston 122*a* and first exhaust valve 114*a*. The bleed path through the central and lateral orifices 820*a* and 822*a* occurs each cycle that the cam lobe 116*a* rotates such that excess pressure is eliminated or released through the central and lateral orifices 820*a* and 822*a*. As such, the first secondary piston 122*a* returns to its initial position during braking cycles and the potential for jacking is eliminated.

Various aspects of the present application are contemplated. According to one aspect, an engine brake reset valve comprising: a cylindrical housing body having an end and a central cavity therein; a first valve part attached to a second valve part, wherein the central cavity is sized to receive the first valve part and the second valve part, the first and second valve parts are movable within the central cavity between open and closed positions; wherein the cylindrical housing body defines a central orifice, when the second valve part is in a closed position the second valve part engages and blocks the central orifice to prevent fluid pressure from entering the central orifice, when the second valve part is in an open position the second valve part moves away from the central orifice to enable fluid pressure to enter the central orifice.

In one embodiment, further comprising: a first spring positioned in the central cavity, the first spring arranged to apply pressure relative to movement of a cam lobe against a first primary piston.

In one embodiment, further comprising: a second spring positioned on the first valve part.

In one embodiment, further comprising: wherein the cylindrical housing body defines a lateral orifice fluidly connected to the central orifice.

In one embodiment, further comprising: a piston crown operably assembled with a piston body positioned in the central cavity, wherein the piston crown includes a cylindrical portion that defines a through-hole therein that is sized to receive the first valve part.

In one embodiment, wherein the first valve part includes a retention clip to retain the first valve part assembled with the piston crown.

In one embodiment, wherein the piston body includes a cylindrical portion that defines a through-hole therein that is sized to receive and retain the cylindrical portion of the piston crown therein.

In one embodiment, wherein the second valve part is spherical in shape.

A first primary piston comprising the engine brake reset valve of any of the embodiments.

In the above description, certain relative terms may be used such as "up," "down," "upper," "lower," "horizontal," "vertical," "left," "right," "proximal," "distal," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In some instances, the benefit of simplicity may provide operational and economic benefits and exclusion of certain elements described herein is contemplated as within the scope of the invention herein by the inventors to achieve such benefits. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An engine brake reset valve for a first primary piston within a cam housing for an exhaust valve hydraulic system, the engine brake reset valve comprising:

a cylindrical housing body having an end and a central cavity therein;

a first valve part attached to a second valve part, wherein the central cavity is sized to receive the first valve part and the second valve part, the first and second valve parts are movable within the central cavity between open and closed positions;

wherein the cylindrical housing body defines a central orifice, when the second valve part is in a closed position the second valve part engages and blocks the central orifice to prevent fluid pressure from entering the central orifice, when the second valve part is in an open position the second valve part moves away from the central orifice to enable fluid pressure to enter the central orifice;

a first spring positioned in the central cavity, the first spring arranged to apply pressure relative to movement of a cam lobe against the first primary piston;

a second spring positioned on the first valve part; and a piston crown operably assembled with a piston body positioned in the central cavity, wherein the piston crown includes a cylindrical portion that defines a through-hole therein that is sized to receive the first valve part.

2. The engine brake reset valve of claim 1, further comprising:

wherein the cylindrical housing body defines a lateral orifice fluidly connected to the central orifice.

3. The engine brake reset valve of claim 1, wherein the first valve part includes a retention clip to retain the first valve part assembled with the piston crown.

4. The engine brake reset valve of claim 1, wherein the piston body includes a cylindrical portion that defines a through-hole therein that is sized to receive and retain the cylindrical portion of the piston crown therein.

5. The engine brake reset valve of claim 1, wherein the second valve part is spherical in shape.

6. A first primary piston comprising the engine brake reset valve of claim 1.

* * * * *